US012680542B2

(12) United States Patent
Bagulayan et al.

(10) Patent No.: US 12,680,542 B2
(45) Date of Patent: Jul. 14, 2026

(54) OPERATING MULTIPLE FRACTURING PUMPS TO DELIVER A SMOOTH TOTAL FLOW RATE TRANSITION

(71) Applicant: Schlumberger Technology Corporation, Sugar Land, TX (US)

(72) Inventors: Amal Bagulayan, Millbrae, CA (US); Nan Mu, Sugar Land, TX (US); James Matthews, Houston, TX (US); Bao Mi, Sugar Land, TX (US); Alexander Tanner Taylor, Missouri City, TX (US); Marcos Suguru Kajita, Houston, TX (US)

(73) Assignee: Schlumberger Technology Corporation, Sugar Land, TX (US)

( * ) Notice: Subject to any disclaimer, the term of this patent is extended or adjusted under 35 U.S.C. 154(b) by 519 days.

(21) Appl. No.: 18/297,762

(22) Filed: Apr. 10, 2023

(65) Prior Publication Data

US 2023/0287880 A1 Sep. 14, 2023

Related U.S. Application Data

(63) Continuation of application No. 16/963,363, filed as application No. PCT/US2019/014651 on Jan. 23, 2019, now Pat. No. 11,649,817.

(Continued)

(51) Int. Cl.

| | |
|---|---|
| ***F04B 23/04*** | (2006.01) |
| ***F04B 49/06*** | (2006.01) |
| ***F04B 49/20*** | (2006.01) |

(52) U.S. Cl.
CPC ..... *F04B 49/065* (2013.01); *F04B 23/04* (2013.01); *F04B 49/20* (2013.01)

(58) Field of Classification Search
CPC ..... F04B 23/04
See application file for complete search history.

(56) References Cited

U.S. PATENT DOCUMENTS 3,068,796 A * 12/1962 Pfluger ..... F17D 1/14 417/18
4,204,808 A * 5/1980 Reese ..... G05D 16/2073 417/18

(Continued)

FOREIGN PATENT DOCUMENTS

RU 2140569 C1 10/1999
RU 2343313 C1 1/2009

(Continued)

OTHER PUBLICATIONS

Search Report and Written Opinion of International Patent Application No. PCT/US2019/014651 issued May 1, 2019; 13 pages.

(Continued)

*Primary Examiner* — Christopher S Bobish
(74) *Attorney, Agent, or Firm* — Jeffrey D. Frantz

(57) ABSTRACT

Changing a cumulative pumping rate of multiple pump units by adjusting individual pumping rates of the pump units, wherein each temporary dip or spike of an individual pumping rate of one of the pump units is automatically offset by a predetermined temporary adjustment of an individual pumping rate of another one or more of the pump units to thereby reduce effects of the temporary dip or spike on the cumulative pumping rate of the pump units.

20 Claims, 7 Drawing Sheets

Related U.S. Application Data

(60) Provisional application No. 62/620,663, filed on Jan. 23, 2018.

(56) References Cited

U.S. PATENT DOCUMENTS

| | | | | |
|---|---|---|---|---|
| 4,580,947 | A * | 4/1986 | Shibata | F04C 28/02 417/53 |
| 4,640,665 | A * | 2/1987 | Staroselsky | F04D 27/0269 415/27 |
| 4,945,491 | A * | 7/1990 | Rishel | G01L 3/26 417/19 |
| 5,586,444 | A * | 12/1996 | Fung | F25B 49/022 318/610 |
| 5,797,729 | A * | 8/1998 | Rafuse, Jr. | F04C 28/08 62/126 |
| 6,045,332 | A * | 4/2000 | Lee | F04D 15/029 137/565.33 |
| 7,010,393 | B2 * | 3/2006 | Mirsky | F04D 15/029 700/282 |
| 7,955,056 | B2 * | 6/2011 | Pettersson | G05D 16/2073 700/282 |
| 10,415,557 | B1 * | 9/2019 | Crowe | F04B 23/04 |
| 10,514,301 | B2 * | 12/2019 | Luharuka | G05B 19/0425 |
| 10,655,435 | B2 * | 5/2020 | Oehring | E21B 44/00 |
| 10,815,764 | B1 * | 10/2020 | Yeung | F04B 23/06 |
| 2009/0053072 | A1 * | 2/2009 | Borgstadt | F04B 47/00 417/63 |
| 2012/0018150 | A1 | 1/2012 | Shampine et al. | |
| 2013/0108473 | A1 * | 5/2013 | Tamminen | F04B 49/103 417/3 |
| 2013/0189118 | A1 * | 7/2013 | Cochran | F04B 23/04 417/2 |
| 2014/0094105 | A1 * | 4/2014 | Lundh | G05D 7/0682 454/168 |
| 2014/0379300 | A1 * | 12/2014 | Devine | F04B 51/00 702/182 |
| 2016/0169221 | A1 * | 6/2016 | Stephenson | F04B 53/162 417/279 |
| 2017/0002636 | A1 * | 1/2017 | Williams | F04B 47/00 |
| 2018/0003180 | A1 | 1/2018 | Raghavachari | |
| 2019/0120024 | A1 * | 4/2019 | Oehring | E21B 43/26 |
| 2019/0232309 | A1 * | 8/2019 | Saine | B05C 11/1039 |

FOREIGN PATENT DOCUMENTS

| | | | |
|---|---|---|---|
| WO | 2016144939 | A1 | 9/2016 |
| WO | 2017106865 | A1 | 6/2017 |

OTHER PUBLICATIONS

International Preliminary Report on Patentability of International Patent Application No. PCT/US2019/014651 issued Aug. 6, 2020; 10 pages.

First Exam Report issued in Saudi Arabian Patent Application No. 520412474 dated Jun. 13, 2022, 15 pages with English translation.

Decision to Grant issued in Russian Patent Appl. No. 2020127743/12 on Jan. 19, 2022; 31 pages (with English translation).

* cited by examiner

OPERATING MULTIPLE FRACTURING PUMPS TO DELIVER A SMOOTH TOTAL FLOW RATE TRANSITION

CROSS-REFERENCE TO RELATED APPLICATIONS

This application is a continuation of U.S. patent application Ser. No. 16/963,363, filed on Jul. 20, 2020, which was the National Stage of International Application No. PCT/US2019/014651, filed on Jan. 23, 2019, which claims priority to and the benefit of U.S. Provisional Application No. 62/620,663, titled "Operating Multiple Fracturing Pumps to Deliver a Smooth Total Flow Rate Transition," filed Jan. 23, 2018. Each of the above disclosures is hereby incorporated herein by reference in its entirety.

BACKGROUND OF THE DISCLOSURE

High-volume, high-pressure pumps are utilized at wellsites for a variety of pumping operations. Such operations may include drilling, cementing, acidizing, water jet cutting, hydraulic fracturing, and other wellsite operations. In some pumping operations, several pumps may be fluidly connected to a well via various fluid conduits and/or a manifold. During such operations, the fluid conduits and/or the manifold distributes low-pressure fluid from a mixer, a blender, and/or other sources among the pumps and combines pressurized fluid from the pumps for injection into the well. Success of the pumping operations at a wellsite may be affected by many factors, such as efficiency, failure rates, and safety related to operation of the pumps. Systematic high pressure and flow rate spikes and vibrations generated by the pumps may cause mechanical fatigue, wear, and/or other damage to the pumps, which may decrease pumping flow rates, quality of downhole operations, and/or efficiency.

To ensure that the pumps produce the intended flow rates or otherwise operate as intended, human operators at the wellsite may manually control or adjust operation of each pump and the associated transmission during downhole pumping operations. For example, during a fracturing job, the flow rate of slurry that is being pumped directly affects pressure at the wellhead, and pressure spikes and dips formed by the fracturing pumps decrease quality of the fracturing job. The pump operator thus attempts to manage the operation of the pumps such that the pumps deliver a smooth total flow rate during slurry flow rate transition (i.e., increase and decrease) phases of the fracturing job.

However, operating fracturing pumps manually by controlling transmissions (e.g., gear selection) and prime movers (e.g., throttles of motors/engines) does not lend itself to such pump control. For example, the pump operator is able to control just one pump at a time. Furthermore, the pumps may be constructed using different components and may have different levels of wear and tear, such that the pumps cannot be accurately controlled via the same transmission and prime mover settings. That is, different fracturing pump components (e.g., the engine, the transmission, the power end, the fluid end, etc.) may have different parameters and capabilities, and different wear levels of different pump components increase the variability in operating the pumps to achieve a target flow rate.

SUMMARY OF THE DISCLOSURE

This summary is provided to introduce a selection of concepts that are further described below in the detailed description. This summary is not intended to identify indispensable features of the claimed subject matter, nor is it intended for use as an aid in limiting the scope of the claimed subject matter.

The present disclosure introduces an apparatus that includes a controller having a processor and a memory storing coded instructions that, when executed by the processor, are for operation of the controller to change a cumulative pumping rate of multiple pump units of a pumping system by adjusting individual pumping rates of the pump units, including such that each temporary dip or spike of an individual pumping rate of one of the pump units is automatically offset by a predetermined temporary adjustment of an individual pumping rate of another one or more of the pump units to thereby reduce effects of the temporary dip or spike on the cumulative pumping rate of the pump units.

The present disclosure also introduces a method that includes causing operation of a controller to change a cumulative pumping rate of multiple pump units by adjusting individual pumping rates of the pump units, including such that each temporary dip or spike of an individual pumping rate of one of the pump units is automatically offset by a predetermined temporary adjustment of an individual pumping rate of another one or more of the pump units to thereby reduce effects of the temporary dip or spike on the cumulative pumping rate of the pump units.

The present disclosure also introduces a method including receiving a rate distribution plan describing each adjustment to individual pumping rates of multiple pump units of a pumping system that will accomplish a cumulative pumping rate change of the pumping system. The pump units are grouped into a first group of the pump units for which the individual pumping rates adjustments are increases and a second group of other ones of the pump units for which the individual pumping rates adjustments are decreases. The method also includes generating a first list of the pump units in the first group sorted by magnitude of the increases, generating a second list of the pump units in the second group sorted by magnitude of the decreases, and generating a transition schedule of ordered transition steps to be executed to accomplish the cumulative pumping rate change. Each transition step includes the individual pumping rate adjustment to be accomplished for one of the pump units, and the transition steps are ordered by decreasing magnitude of alternating increasing and decreasing individual pumping rate adjustments.

The present disclosure also introduces an apparatus including a controller capable of communicatively connecting to each pump unit controller of multiple pump units. Each pump unit controller is in communication with at least one of a variable frequency drive, an engine throttle, a gear shifter, a prime mover, or a transmission of the corresponding pump unit. The controller includes a programmable processor having a memory device and an interface circuit connected to an input device. The programmable processor is operable to process coded instructions from the input device and communicate the coded instructions to the pump unit controllers. The at least one of the variable frequency drive, the engine throttle, the gear shifter, the prime mover, and/or the transmission of each pump unit is responsive to the coded instructions to change a cumulative pumping rate of the pump units. Each temporary dip or spike of an individual pumping rate of one of the pump units is automatically offset by a predetermined temporary adjustment of an individual pumping rate of another one or more of the pump units to thereby reduce effects of the temporary dip or spike on the cumulative pumping rate of the pump units.

These and additional aspects of the present disclosure are set forth in the description that follows, and/or may be learned by a person having ordinary skill in the art by reading the material herein and/or practicing the principles described herein. At least some aspects of the present disclosure may be achieved via means recited in the attached claims.

BRIEF DESCRIPTION OF THE DRAWINGS

The present disclosure is understood from the following detailed description when read with the accompanying figures. It is emphasized that, in accordance with the standard practice in the industry, various features are not drawn to scale. In fact, the dimensions of the various features may be arbitrarily increased or reduced for clarity of discussion.

DETAILED DESCRIPTION

Figure 1:
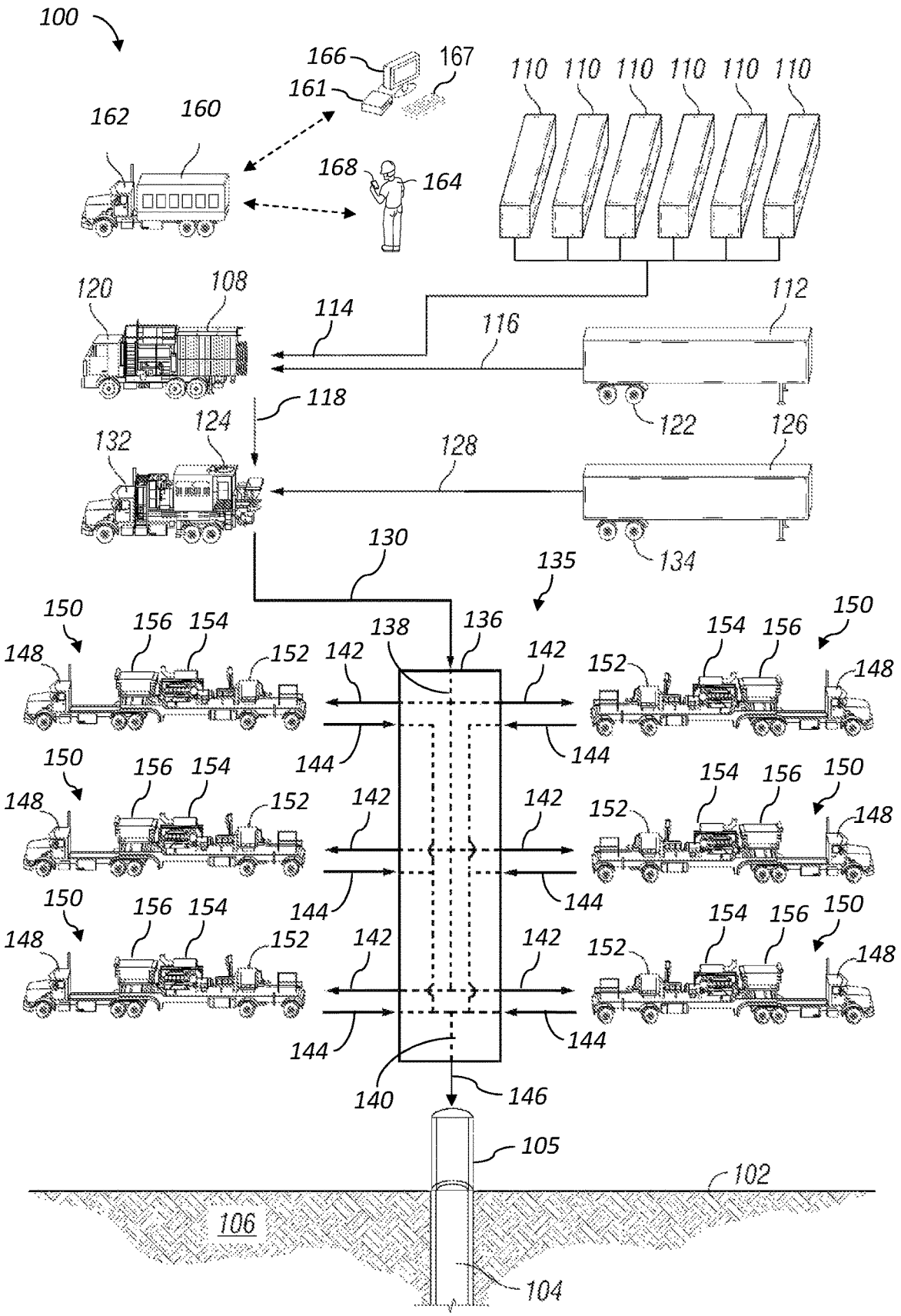
FIG. 1 is a schematic view of at least a portion of an example implementation of apparatus according to one or more aspects of the present disclosure.

It is to be understood that the following disclosure provides many different embodiments, or examples, for implementing different features or combinations of features. Specific examples of components and arrangements are described below to simplify the present disclosure. These are merely examples and are not intended to be limiting. In addition, the present disclosure may repeat reference numerals and/or letters in the various examples. This repetition is for simplicity and clarity and does not in itself dictate a relationship between the various embodiments and/or configurations discussed.

FIG. 1 is a schematic view of at least a portion of an example environment in which a control system according to one or more aspects of the present disclosure may be utilized. The figure shows a wellsite 102, a wellbore 104 extending from the terrain surface of the wellsite 102, a partial sectional view of a subterranean formation 106 penetrated by the wellbore 104, a wellhead 105, and a wellsite system 100 comprising various pieces of equipment or components located at the wellsite 102. The wellsite system 100 may be operable to transfer various materials and additives between corresponding sources and destinations, such as for blending or mixing and subsequent injection into the wellbore 104 during fracturing operations.

The wellsite system 100 may comprise a mixing unit 108 (referred to hereinafter as a "mixer") fluidly connected with one or more tanks 110 and a container 112. The container 112 may contain a first material and the tanks 110 may contain a liquid. The first material may be or comprise a hydratable material or gelling agent, such as cellulose, clay, galactomannan, guar, polymers, synthetic polymers, and/or polysaccharides, among other examples. The liquid may be or comprise an aqueous fluid, such as water or an aqueous solution comprising water, among other examples. The mixer 108 may be operable to receive the first material and the liquid, via two or more conduits or other material transfer means (hereafter simply "conduits") 114, 116, and mix or otherwise combine the first material and the liquid to form a base fluid, which may be or comprise that which is known in the art as a gel. The mixer 108 may then discharge the base fluid via one or more fluid conduits 118.

The wellsite system 100 may further comprise a mixer 124 fluidly connected with the mixer 108 and a container 126. The container 126 may contain a second material that may be substantially different than the first material. For example, the second material may be or comprise a proppant material, such as quartz, sand, sand-like particles, silica, and/or propping agents, among other examples. The mixer 124 may be operable to receive the base fluid from the mixer 108 (via the one or more conduits 118) and the second material from the container 126 (via one or more conduits 128) and mix or otherwise combine the base fluid and the second material to form a mixture. The mixture may be or comprise that which is known in the art as a fracturing fluid.

One or more conduits 130 may communicate the mixture from the mixer 124 to a manifold 136, which may be known in the art as a missile or a missile trailer. The manifold 136 may comprise a low-pressure manifold 138 and a high-pressure manifold 140 (as well as various valves and diverters not labeled in FIG. 1). The manifold 136 may distribute the mixture to a fleet of pump units 150 via the low-pressure distribution manifold 138. Although the pump fleet is shown comprising six pump units 150, the pump fleet may comprise another number of pump units 150 within the scope of the present disclosure. The manifold 136 and the pump units 150 (and perhaps other components) collectively form a pumping system 135.

Each pump unit 150 may comprise a pump 152, a prime mover 154, and perhaps a heat exchanger 156. Each pump unit 150 may receive the mixture from a corresponding outlet of the low-pressure manifold 138, such as via one or more conduits 142, and then pressurize the mixture and discharge the high-pressure mixture into a corresponding inlet of the high-pressure manifold 140, such as via one or more conduits 144. The pressurized mixture may then be discharged from the high-pressure manifold 140 into the wellbore 104, such as via one or more conduits 146, the wellhead 105, and perhaps various additional valves, conduits, and/or other hydraulic circuitry (not shown) fluidly connected between the manifold 136 and the wellbore 104.

The wellsite system 100 may also have a control center 160 comprising a controller 161 (e.g., a processing device, a computer, a PLC, etc.), which may be operable to provide control to one or more portions of the wellsite system 100 and/or to monitor health and functionality of one or more portions of the wellsite system 100. The controller 161 (also referred to herein as the coordinating controller 161) may be communicatively connected with the various wellsite equipment described herein, and may be operable to receive signals from and transmit signals to such equipment to perform various operations described herein. For example, the controller 161 may be operable to monitor and control one or more portions of the mixers 108, 124, the pump units 150, the manifold 136, and various other pumps, conveyers, and/or other wellsite equipment (not shown) disposed along the conduits 114, 116, 118, 128, 130, such as may be collectively operable to move, mix, separate, and/or measure the fluids, materials, and/or mixtures described above and inject such fluids, materials, and/or mixtures into the wellbore 104. The controller 161 may store control commands, operational parameters and set-points, coded instructions, executable programs, and other data or information, including for implementing one or more aspects of the operations described herein. Communication between the controller 161 and the various portions of the wellsite system 100 may be via wired and/or wireless communication means. However, for clarity and ease of understanding, such communication means are not depicted in FIG. 1, and a person having ordinary skill in the art will appreciate that such communication means are within the scope of the present disclosure.

A field engineer, equipment operator, or field operator (collectively referred to hereinafter as a "wellsite operator") 164 may operate one or more components, portions, or systems of the wellsite equipment and/or perform maintenance or repair on the wellsite equipment. For example, the wellsite operator 164 may assemble the wellsite system 100, operate the wellsite equipment (e.g., via the controller 161) to perform the fracturing operations, check equipment operating parameters, and/or repair or replace malfunctioning or inoperable wellsite equipment, among other operational, maintenance, and repair tasks, collectively referred to hereinafter as wellsite operations. The wellsite operator 164 may perform wellsite operations individually or with other wellsite operators.

The controller 161 may be communicatively connected with one or more human-machine interface (HMI) devices, such as may be utilized by the wellsite operator 164 for entering or otherwise communicating the control commands to the controller 161, and for displaying or otherwise communicating information from the controller 161 to the wellsite operator 164. The HMI devices may include one or more input devices 167 (e.g., a keyboard, a mouse, a joystick, a touchscreen, etc.) and one or more output devices 166 (e.g., a video monitor, a printer, audio speakers, etc.). The HMI devices may also include a mobile communication device 168 (e.g., a smartphone, a tablet computer, a laptop computer, etc.). Communication between the controller and the HMI devices may be via wired and/or wireless communication means.

One or more of the containers 112, 126, the mixers 108, 124, the pump units 150, and the control center 160 may each be disposed on corresponding trucks, trailers, and/or other mobile carriers 122, 134, 120, 132, 148, 162, respectively, such as may permit their transportation to the wellsite surface 102. However, one or more of the containers 112, 126, the mixers 108, 124, the pump units 150, and the control center 160 may each be skidded or otherwise stationary, and/or may be temporarily or permanently installed at the wellsite surface 102.

FIG. 1 depicts the wellsite system 100 as being operable to transfer additives and produce mixtures that may be pressurized and injected into the wellbore 104 during hydraulic fracturing operations. However, it is to be understood that the wellsite system 100 may be operable to transfer other additives and produce other mixtures that may be pressurized and injected into the wellbore 104 during other oilfield operations, such as cementing, drilling, acidizing, chemical injecting, and/or water jet cutting operations, among other examples. Accordingly, unless described otherwise, the one or more fluids being pumped by a pump unit 150 may be referred to hereinafter as simply "a fluid."

Figure 2:
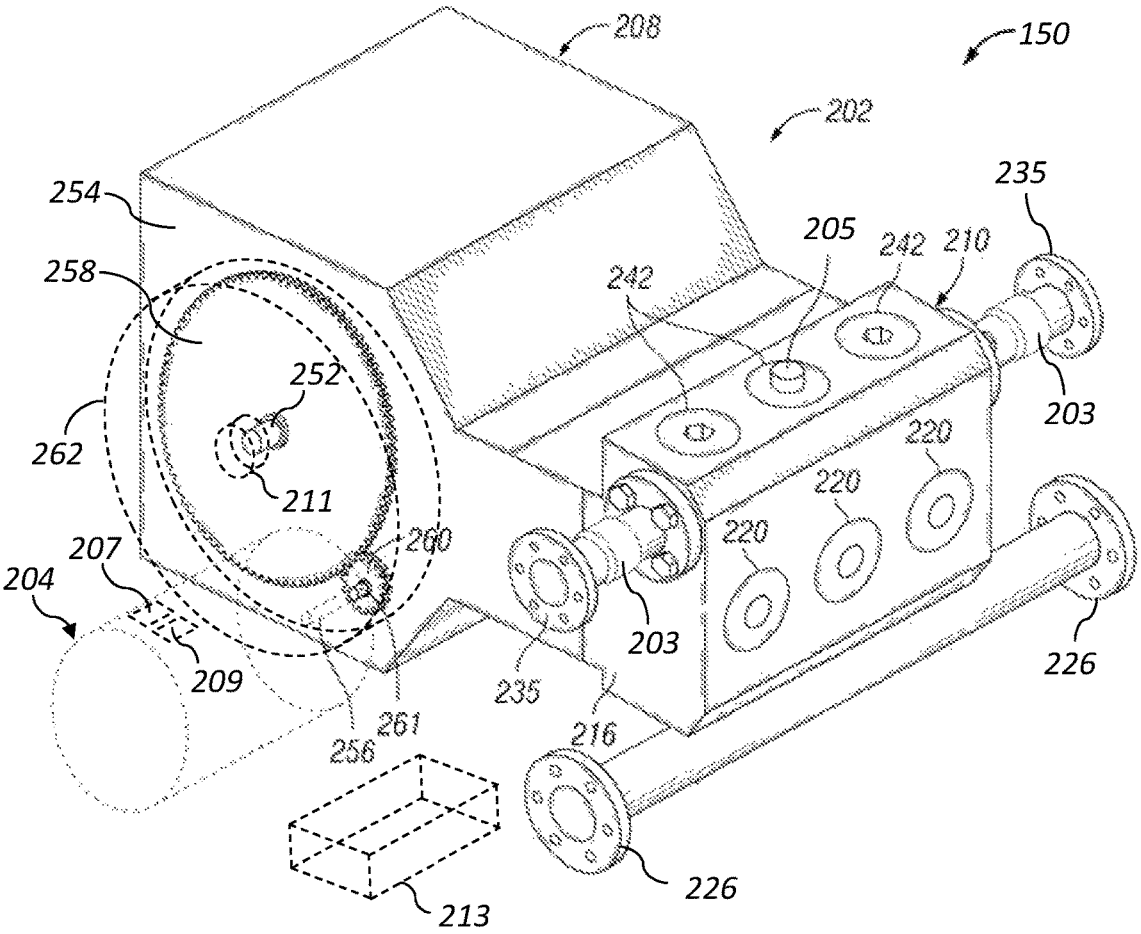
FIG. 2 is a schematic perspective view of a portion of an example implementation of the apparatus shown in FIG. 1 according to one or more aspects of the present disclosure.
Figure 3:
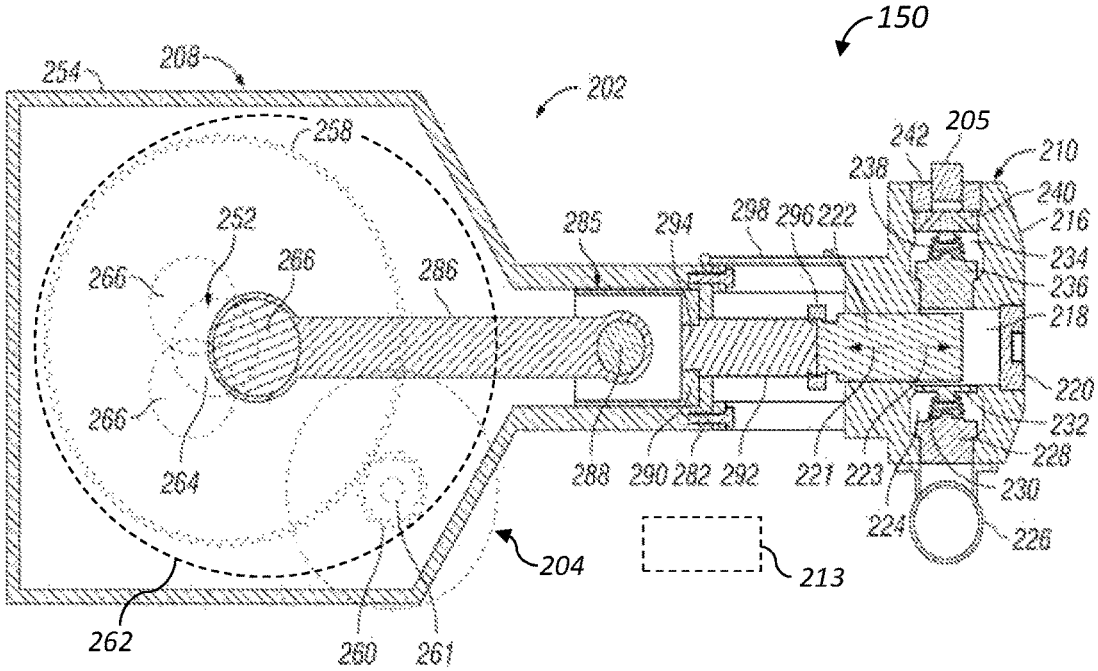
FIG. 3 is a schematic sectional view of a portion of an example implementation of the apparatus shown in FIG. 2 according to one or more aspects of the present disclosure.

FIG. 2 is a perspective schematic of view an example implementation of a portion of an instance of the pump units 150 shown in FIG. 1 according to one or more aspects of the present disclosure. FIG. 3 is a side sectional view of a portion of the pump unit 150 shown in FIG. 2. Portions of the pump unit 150 shown in FIGS. 2 and 3 are shown in phantom lines, such as to prevent obstruction from view of other portions of the pump unit 150. The following description refers to FIGS. 1-3, collectively.

The pump unit 150 comprises a pump 202 operatively coupled with and actuated by a prime mover 204. The pump 202 includes a power section 208 and a fluid section 210. The fluid section 210 may comprise a pump housing 216 having a plurality of fluid chambers 218. One end of each fluid chamber 218 may be plugged by a cover plate 220, such as may be threadedly engaged with the pump housing 216, while an opposite end of each fluid chamber 218 may contain a reciprocating member 222 slidably disposed therein and operable to displace the fluid within the corresponding fluid chamber 218. Although the reciprocating member 222 is depicted as a plunger, the reciprocating member 222 may also be implemented as a piston, diaphragm, or another reciprocating, fluid-displacing member.

Each fluid chamber 218 is fluidly connected with a corresponding one of a plurality of fluid inlet cavities 224 each adapted for communicating fluid from a fluid inlet 226 into the corresponding fluid chamber 218. The fluid inlet 226 may be in fluid communication with the corresponding conduit 142 for receiving fluid from the low-pressure manifold 138. Each fluid inlet cavity 224 may contain an inlet valve 228 operable to control fluid flow from the fluid inlet 226 into the corresponding fluid chamber 218. Each inlet valve 228 may be biased toward a closed flow position by a spring or another biasing member 230, which may be held in place by an inlet valve stop 232. Each inlet valve 228 may be actuated to an open flow position by a predetermined differential pressure between the corresponding fluid inlet cavity 224 and the fluid inlet 226.

Each fluid chamber 218 is also fluidly connected with a fluid outlet cavity 234 extending through the pump housing 216 transverse to the reciprocating members 222. The fluid outlet cavity 234 is adapted for communicating pressurized fluid from each fluid chamber 218 into one or more fluid outlets 235 fluidly connected at one or both ends of the fluid outlet cavity 234. The fluid outlets 235 may be in fluid communication with the corresponding conduit 144 for communicating pressurized fluid to the high-pressure manifold 140. The fluid section 210 also contains a plurality of outlet valves 236 each operable to control fluid flow from a corresponding fluid chamber 218 into the fluid outlet cavity 234. Each outlet valve 236 may be biased toward a closed flow position by a spring or other biasing member 238, which may be held in place by an outlet valve stop 240. Each outlet valve 236 may be actuated to an open flow position by a predetermined differential pressure between the corresponding fluid chamber 218 and the fluid outlet cavity 234. The fluid outlet cavity 234 may be plugged by cover plates 242, such as may be threadedly engaged with the pump housing 216.

During pumping operations, portions of the power section 208 rotate in a manner that generates a reciprocating linear motion to move the reciprocating members 222 longitudinally within the corresponding fluid chambers 218, thereby alternatingly drawing and displacing the fluid within the fluid chambers 218. With regard to each reciprocating member 222, as the reciprocating member 222 moves out of the fluid chamber 218, as indicated by arrow 221, the pressure of the fluid inside the corresponding fluid chamber 218 decreases, thus creating a differential pressure across the corresponding fluid inlet valve 228. The pressure differential operates to compress the biasing member 230, thus actuating the fluid inlet valve 228 to an open flow position to permit the fluid from the fluid inlet 226 to enter the corresponding fluid inlet cavity 224. The fluid then enters the fluid chamber 218 as the reciprocating member 222 continues to move longitudinally out of the fluid chamber 218 until the pressure difference between the fluid inside the fluid chamber 218 and the fluid at the fluid inlets 226 is low enough to permit the biasing member 230 to actuate the fluid inlet valve 228 to the closed flow position. As the reciprocating member 222 begins to move longitudinally back into the fluid chamber 218, as indicated by arrow 223, the pressure of the fluid inside the fluid chamber 218 begins to increase. The fluid pressure inside the fluid chamber 218 continues to increase as the reciprocating member 222 continues to move into the fluid chamber 218 until the pressure of the fluid inside the fluid chamber 218 is high enough to overcome the pressure of the fluid inside the fluid outlet cavity 234 and compress the biasing member 238, thus actuating the fluid outlet valve 236 to the open flow position and permitting the pressurized fluid to move into the fluid outlet cavity 234, the fluid outlets 235, and the corresponding fluid conduit 144.

The pump unit 150 may comprise one or more flow rate sensors 203 fluidly coupled with or along the fluid outlets 235 in a manner permitting monitoring of a fluid flow rate of the fluid flowing through the fluid outlets 235. Each flow sensor 203 may be or comprise a flow meter operable to measure the volumetric and/or mass flow rate of the fluid discharged from the pump unit 150, and to generate signals or information indicative of the flow rate of the fluid discharged from the pump unit 150. The pump unit 150 may further comprise a pressure sensor 205 disposed in association with the fluid section 210 in a manner permitting the sensing of fluid pressure at the fluid outlets 235. For example, the pressure sensor 205 may extend through one or more of the cover plates 242 or other portions of the corresponding pump housing 216 to monitor pressure within the fluid outlet cavity 234 and, thus, the fluid outlets 235 and the corresponding outlet conduits 144.

The fluid flow rate generated by the pump unit 150 may depend on the physical size of the reciprocating members 222 and fluid chambers 218, as well as the pump unit operating speed, which may be defined by the speed or rate at which the reciprocating members 222 cycle or move within the fluid chambers 218. The pumping speed, such as the speed or the rate at which the reciprocating members 222 move, may be related to the rotational speed of the power section 208 and/or the prime mover 204. Accordingly, the fluid flow rate generated by the pump unit 150 may be controlled by controlling the rotational speed of the power section 208 and/or the prime mover 204.

The prime mover 204 may be or comprise a gasoline, diesel, or other engine, a synchronous, asynchronous, or other electric motor (e.g., a synchronous permanent magnet motor), a hydraulic motor, or another prime mover operable to drive or otherwise rotate a drive shaft 252 of the power section 208. The drive shaft 252 may be enclosed and maintained in position by a power section housing 254. To prevent relative rotation between the power section housing 254 and the prime mover 204, the power section housing 254 and prime mover 204 may be fixedly coupled together or to a common base, such as a trailer of the mobile carrier 148.

The prime mover 204 may comprise a rotatable output shaft 256 operatively connected with the drive shaft 252 via a gear train or transmission 262, which may comprise a spur gear 258 coupled with the drive shaft 252 and a corresponding pinion gear 260 coupled with a support shaft 261. The output shaft 256 and the support shaft 261 may be coupled, such as may facilitate transfer of torque from the prime mover 204 to the support shaft 261, the pinion gear 260, the spur gear 258, and the drive shaft 252. For clarity, FIGS. 2 and 3 show the transmission 262 comprising a single spur gear 258 engaging a single pinion gear 260, however, it is to be understood that the transmission 262 may comprise a plurality of corresponding sets of gears, such as may permit the transmission 262 to be shifted between different gear sets (i.e., combinations) to control the operating speed of the drive shaft 252 and the torque transferred to the drive shaft 252. Accordingly, the transmission 262 may be shifted between different gear sets ("gears") to vary the pumping speed and torque of the power section 208 and, thereby, vary the fluid flow rate and maximum fluid pressure generated by the fluid section 210.

The transmission 262 may also comprise a torque converter (not shown) operable to selectively connect ("lock-up") the prime mover 204 with the transmission 262 and permit slippage ("unlock") between the prime mover 204 and the transmission 262. The torque converter and the gears of the transmission 262 may be shifted manually by the wellsite operator 164 or remotely via a gear shifter, which may be incorporated as part of a pump unit controller 213. The gear shifter may receive control signals from the controller 161 and output a corresponding electrical or mechanical control signal to shift the gear of the transmission 262 and lock-up the transmission, such as to control the fluid flow rate and the operating pressure of the pump unit 150.

The drive shaft 252 may be implemented as a crankshaft comprising a plurality of axial journals 264 and offset journals 266. The axial journals 264 may extend along a central axis of rotation of the drive shaft 252, while the offset journals 266 may be offset from the central axis of rotation by a distance and spaced 120 degrees apart with respect to the axial journals 264. The drive shaft 252 may be supported in position within the power section 208 by the power section housing 254, wherein two of the axial journals 264 may extend through opposing openings in the power section housing 254.

The power section 208 and the fluid section 210 may be coupled or otherwise connected together. For example, the pump housing 216 may be fastened with the power section housing 254 by a plurality of threaded fasteners 282. The pump 202 may further comprise an access door 298, which may facilitate access to portions of the pump 202 located between the power section 208 and the fluid section 210, such as during assembly and/or maintenance of the pump 202.

To transform and transmit the rotational motion of the drive shaft 252 to a reciprocating linear motion of the reciprocating members 222, a plurality of crosshead mechanisms 285 may be utilized. For example, each crosshead mechanism 285 may comprise a connecting rod 286 pivotally coupled with a corresponding offset journal 266 at one end and with a pin 288 of a crosshead 290 at an opposing end. During pumping operations, walls and/or interior portions of the power section housing 254 may guide each crosshead 290, such as may reduce or eliminate lateral motion of each crosshead 290. Each crosshead mechanism 285 may further comprise a piston rod 292 coupling the crosshead 290 with the reciprocating member 222. The piston rod 292 may be coupled with the crosshead 290 via a threaded connection 294 and with the reciprocating member 222 via a flexible connection 296.

The pump unit 150 may further comprise one or more rotational position and speed ("rotary") sensors 211 operable to generate a signal or information indicative of rotational position, rotational speed, and/or operating frequency of the pump 202. For example, one or more of the rotary sensors 211 may be operable to convert angular position or motion of the drive shaft 252 or another rotating portion of the power section 208 to an electrical signal indicative of pumping speed of the pump unit 150. One or more of the rotary sensors 211 may be mounted in association with an external portion of the drive shaft 252 or other rotating member of the power section 208. One or more of the rotary sensors 211 may also or instead be mounted in association of the prime mover 204 to monitor the rotational position and/or rotational speed of the prime mover 204, which may be utilized to determine the pumping speed of the pump unit 150. Each rotary sensor 211 may be or comprise an encoder, a rotary potentiometer, a synchro, a resolver, and/or an RVDT (rotary variable differential transformer), among other examples.

The pump unit controller 213 may further include prime mover power and/or control components, such as a variable frequency drive (VFD) and/or an engine throttle control, which may be utilized to facilitate control of the prime mover 204. The VFD and/or throttle control may be connected with or otherwise in communication with the prime mover 204 via mechanical and/or electrical communication means (not shown). The pump unit controller 213 may include the VFD in implementations in which the prime mover 204 is or comprises an electric motor, and the pump unit controller 213 may include the engine throttle control in implementations in which the prime mover 204 is or comprises an engine. For example, the VFD may receive control signals from the controller 161 and output corresponding electrical power to control the speed and the torque output of the prime mover 204 and, thus, control the pumping speed and fluid flow rate of the pump unit 150, as well as the maximum pressure generated by the pump unit 150. The throttle control may receive control signals from the controller 161 and output a corresponding electrical or mechanical throttle control signal to control the speed of the prime mover 204 to control the pumping speed and, thus, the fluid flow rate generated by the pump unit 150. Although the pump unit controller 213 is shown located near or in association with the prime mover 204, the pump unit controller 213 may be located or disposed at a distance from the prime mover 204. For example, the pump unit controller 213 may be located within or form a portion of the control center 160.

A resistance temperature detector (RTD) or other temperature sensor 207 may be disposed in association with the prime mover 204, such as to generate a signal or information indicative of a temperature of the prime mover 204. For example, the temperature sensor 207 may monitor the temperature within a motor winding, an engine housing, or within another portion of the prime mover 204. The temperature sensor 207 may be in communication with the controller 161, which may shut down the prime mover 204 if the detected temperature level exceeds a predetermined temperature level.

A moisture sensor 209 may also be disposed in association with the prime mover 204, such as to generate a signal or information indicative of moisture present at or near the prime mover 204. The moisture sensor 209 may be in communication with the controller 161, which may shut down the prime mover 204 if excessive moisture is detected by the moisture sensor 209.

As described above, the controller 161 may be further operable to monitor and control various operational parameters of the pump units 150. The controller 161 may be in communication with the various sensors of the pump units 150, including the flow rate sensors 203, the pressure sensors 205, the temperature sensor 207, the moisture sensor 209, and the rotary sensor 211, to facilitate monitoring of the pump units 150. The controller 161 may be in communication with the transmission 262 via the gear shifter of the controller 213, such as to control the flow rate and pressure generated by the pump unit 150 to facilitate control of the pump unit 150. The controller 161 may also be in communication with the prime mover 204 via the VFD of the controller 213 if the prime mover 204 is an electric motor or via the throttle control of the controller 213 if the prime mover 204 is an engine, such as may permit the controller 161 to activate, deactivate, and control the flow rate generated by the pump unit 150.

Although FIGS. 2 and 3 show the pump unit 150 comprising a triplex reciprocating pump 202, which has three fluid chambers 218 and three reciprocating members 222, implementations within the scope of the present disclosure may include the pump 202 as or comprising a quintuplex reciprocating pump having five fluid chambers 218 and five reciprocating members 222, or a pump having other quantities of fluid chambers 218 and reciprocating members 222. It is further noted that the pump 202 described above and shown in FIGS. 2 and 3 is merely an example, and that other pumps, such as diaphragm pumps, gear pumps, external circumferential pumps, internal circumferential pumps, lobe pumps, and other positive displacement pumps, are also within the scope of the present disclosure.

Figure 4:
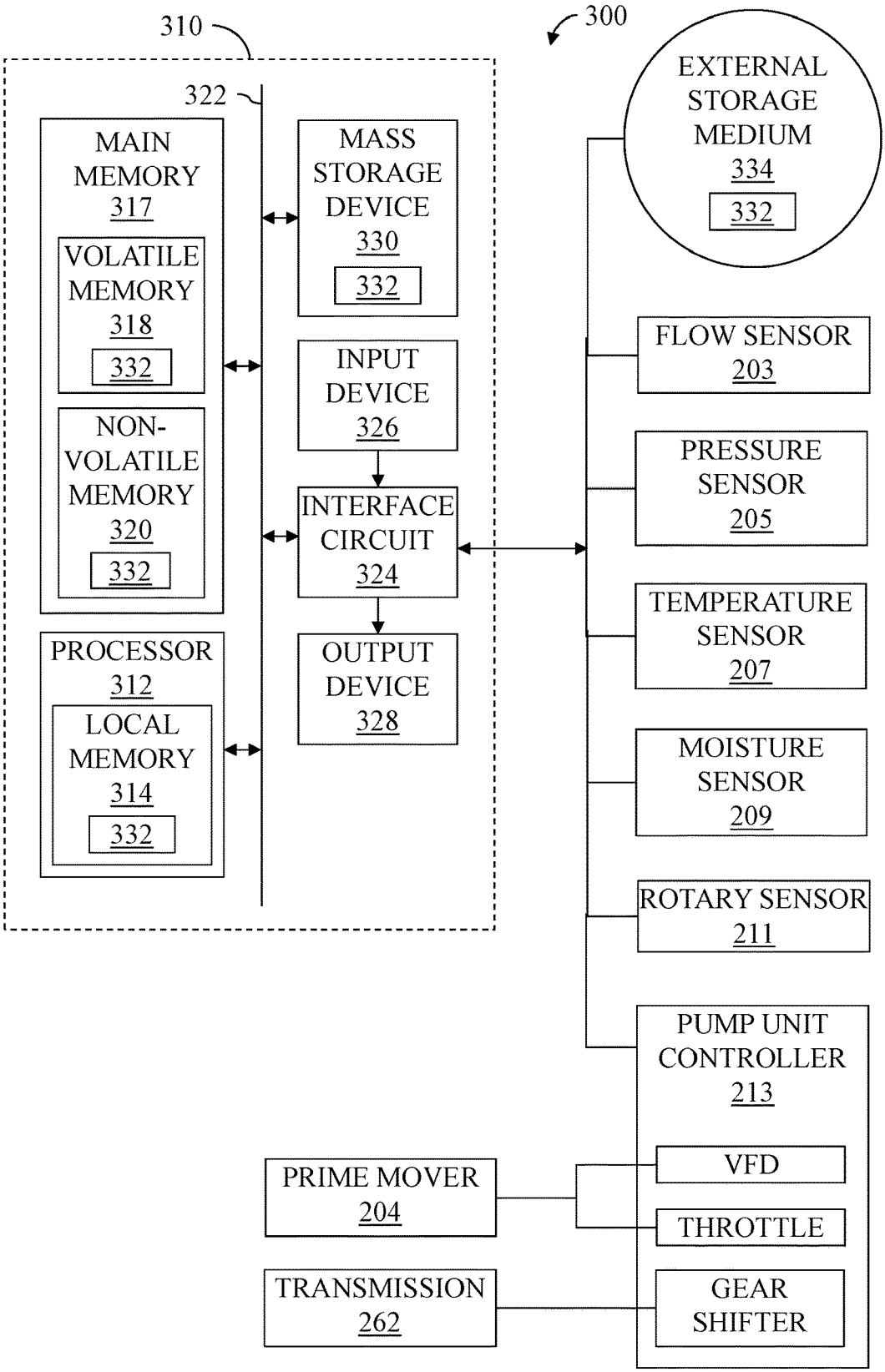
FIG. 4 is a schematic view of at least a portion of an example implementation of apparatus according to one or more aspects of the present disclosure.

The present disclosure further provides various implementations of systems and/or methods for controlling various portions of the wellsite system 100, including the pump units 150 described above. An implementation of such system may comprise a control system 300, such as may be operable to monitor and/or control operations of the pump units 150, including fluid flow rate generated by the pump units 150. FIG. 4 is a schematic view of a portion of an example implementation of the control system 300 according to one or more aspects of the present disclosure. The following description refers to FIGS. 1-4, collectively.

The control system 300 may include a controller 310 communicatively connected with each pump unit 150. For example, the controller 310 may be communicatively connected with each flow sensor 203, pressure sensor 205, temperature sensor 207, moisture sensor 209, rotary sensor 211, and prime mover 204 and transmission 262 via each pump unit controller 213. For clarity, these and other components in communication with the controller 310 will be collectively referred to hereinafter as "sensors and controlled components." The controller 310 may be operable to receive signals or information from the various sensors of the control system 300, the received signals or information being indicative of the various operational parameters of the pump units 150. The controller 310 may be further operable to process such operational parameters and communicate control signals to the prime movers 204 and the transmissions 262 to execute example machine-readable instructions to implement at least a portion of one or more of the example methods and/or processes described herein, and/or to implement at least a portion of one or more of the example systems described herein. The controller 310 may be or form a portion of the controller 161 described above.

The controller 310 may be or comprise, for example, one or more general-purpose or special-purpose processors, such as of personal computers, laptop computers, tablet computers, personal digital assistant (PDA) devices, smartphones, servers, internet appliances, and/or other types of computing devices. For clarity and ease of understanding, the example implementation of the controller 310 depicted in FIG. 4 includes just one processor 312, it being understood that multiple processors 312 may exist.

The processor 312 may be a general-purpose programmable processor, such as may comprise a local memory 314 and that may execute coded instructions 332 present in the local memory 314 and/or another memory device. The processor 312 may execute, among other things, machine-readable instructions or programs to implement the example methods and/or processes described herein. The programs stored in the local memory 314 may include program instructions or computer program code that, when executed by an associated processor, control the pump units 150 in performing the example methods and/or processes described herein. The processor 312 may be, comprise, or be implemented by one or a plurality of processors of various types suitable to the local application environment, and may include one or more general-purpose or special-purpose computers, microprocessors, digital signal processors (DSPs), field-programmable gate arrays (FPGAs), application-specific integrated circuits (ASICs), and processors based on a multi-core processor architecture, as non-limiting examples. Other processors from other families are also appropriate.

The processor 312 may be in communication with a main memory 317, such as may include a volatile memory 318 and a non-volatile memory 320, perhaps via a bus 322 and/or other communication means. The volatile memory 318 may be, comprise, or be implemented by random access memory (RAM), static random access memory (SRAM), synchronous dynamic random access memory (SDRAM), dynamic random access memory (DRAM), RAMBUS dynamic random access memory (RDRAM), and/or other types of random access memory devices. The non-volatile memory 320 may be, comprise, or be implemented by read-only memory, flash memory, and/or other types of memory devices. One or more memory controllers (not shown) may control access to the volatile memory 318 and/or non-volatile memory 320. The controller 310 may be operable to store or record information entered by the wellsite operator 164 and/or information generated by the sensors and controlled components on the main memory 317.

The controller 310 may also comprise an interface circuit 324. The interface circuit 324 may be, comprise, or be implemented by various types of standard interfaces, such as an Ethernet interface, a universal serial bus (USB), a third-generation input/output (3GIO) interface, a wireless interface, and/or a cellular interface, among other examples. The interface circuit 324 may also comprise a graphics driver card. The interface circuit 324 may also comprise a communication device, such as a modem or network interface card to facilitate exchange of data with external computing devices via a network (e.g., Ethernet connection, digital subscriber line (DSL), telephone line, coaxial cable, cellular telephone system, satellite, etc.). One or more of the sensors and controlled components may be connected with the controller 310 via the interface circuit 324, such as may facilitate communication between the sensors and controlled components and the controller 310.

One or more input devices 326 may also be connected to the interface circuit 324. The input devices 326 may permit the wellsite operator 164 to enter the coded instructions 332, operational target set-points, and/or other data into the processor 312. The operational target set-points may include, but are not limited to, a pressure target set-point, a flow rate target set-point, a combined flow rate transition curve set-point, a pump operating or pumping speed target set-point, and a time or duration target set-point, among other examples. The coded instructions may also include a flow rate transition schedule for each pump unit 150 and a combined flow rate transition schedule for the pump units 150 allocated for a job. The coded instructions 332 and operational target set-points are described in more detail below. The input devices 326 may be, comprise, or be implemented by a keyboard, a mouse, a touchscreen, a track-pad, a trackball, an isopoint, and/or a voice recognition system, among other examples. One or more output devices 328 may also be connected to the interface circuit 324. The output devices 328 may be, comprise, or be implemented by display devices (e.g., a liquid crystal display (LCD) or cathode ray tube display (CRT)), printers, and/or speakers, among other examples. The controller 310 may also communicate with one or more mass storage devices 330 of the controller 310 and/or a removable storage medium 334, such as may be or include floppy disk drives, hard drive disks, compact disk (CD) drives, digital versatile disk (DVD) drives, and/or USB and/or other flash drives, among other examples.

The coded instructions 332, the operational target set-points, and/or other data may be stored in the mass storage device 330, the main memory 317, the local memory 314, and/or the removable storage medium 334. Thus, the controller 310 may be implemented in accordance with hardware (perhaps implemented in one or more chips including an integrated circuit, such as an ASIC), or may be implemented as software or firmware for execution by the processor 312. In the case of firmware or software, the implementation may be provided as a computer program product including a computer-readable medium or storage structure embodying computer program code (i.e., software or firmware) thereon for execution by the processor 312.

The coded instructions 332 may include program instructions or computer program code that, when executed by the processor 312, may cause the pump units 150 to perform methods, processes, and/or routines described herein. For example, the controller 310 may receive and process the operational target set-points entered by the operator 164 and the signals or information generated by the various sensors described herein indicative of the operational parameters of the pump units 150. Based on the coded instructions 332 and the received operational target set-points and operational parameters, the controller 310 may send signals or information to the prime movers 204 and the transmissions 262 to cause the pump units 150 and/or other portions of the wellsite system 100 to automatically perform and/or undergo one or more operations or routines within the scope of the present disclosure.

Figure 5:
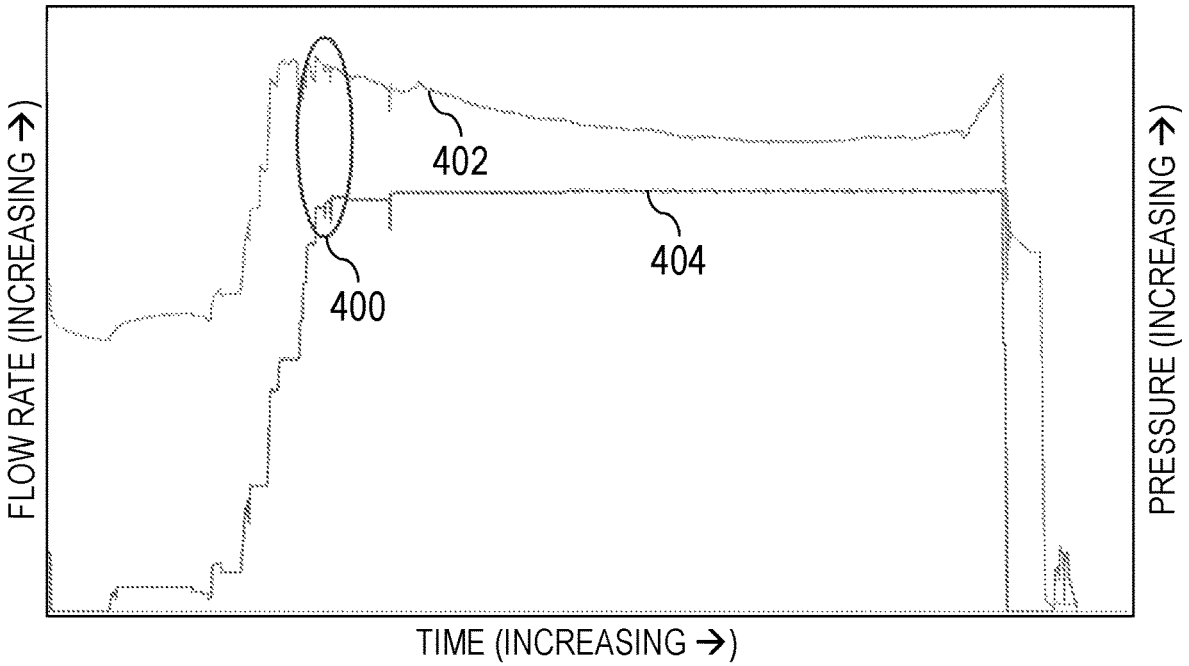
FIG. 5 is a graph related to one or more aspects of the present disclosure.
Figure 6:
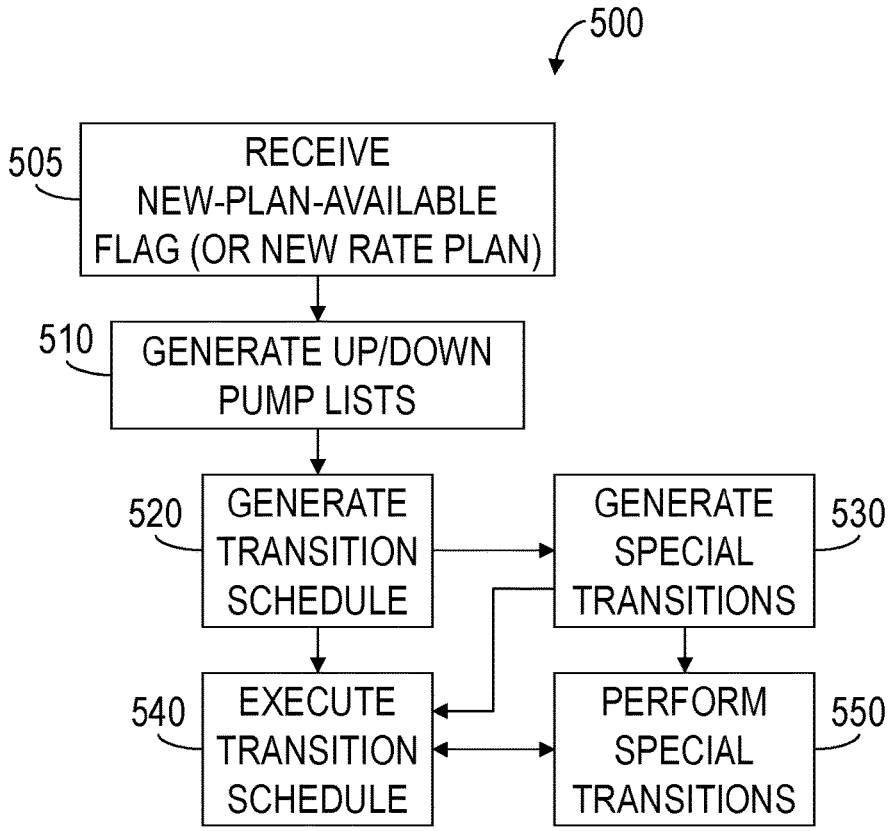
FIG. 6 is a flow-chart diagram of at least a portion of an example implementation of a method according to one or more aspects of the present disclosure.

However, as described above, gear shifts and other factors can result in sudden pressure and/or flow rate changes of the pumping system 135, such as the sudden changes 400 in pressure 402 and flow rate 404 depicted in the graph of FIG. 5. The present disclosure introduces one or more aspects pertaining to reducing the sudden changes via automated, smooth (or smoother) rate transition methods utilizing the ability to closely monitor the automation state and operation parameters of the individual pump units 150 of the pumping system 135. FIG. 6 is a flow-chart diagram of at least a portion of an example implementation 500 of such method according to one or more aspects of the present disclosure. The method 500 may be performed in conjunction with at least a portion of the apparatus depicted in one or more of FIGS. 1-4.

The method 500 may comprise receiving 505 a New-Plan-Available flag from a rate distribution planner. Such receipt 505 may also or instead comprise receiving a new rate distribution plan. The rate distribution planner may be implemented as an algorithm, program, method, etc., within a master rate controller operable to plan the rates of the pump units 150. The master rate controller may be, comprise, or be implemented via at least a portion of the processing systems described above.

For example, in the example implementation depicted in FIG. 1, when the pumping system 135 is operating to provide a cumulative pumping rate (i.e., the collective pumping rate of the currently operating ones of the pump units 150), the new plan describes how the pump units 150 are to be adjusted so that the pumping system will achieve a new "target" cumulative pumping rate. The new cumulative pumping rate of the pumping system 135 may be greater than or less than the current cumulative pumping rate. The New-Plan-Available flag indicates that a plan has been generated (e.g., by the master rate controller and/or other means) for distributing the new rates to the pump units 150 that will achieve the new cumulative pumping rate of the pumping system 135. The new plan describes which (if any) pump units 150 will experience an increase in pumping rate, referred to herein as going-up or ramp-up pump units, and which (if any) pump units 150 will experience a decrease in pumping rate, referred to herein as going-down or ramp-down pump units. That is, the new plan describes how the throttles and/or gears of the currently operating ones of the pump units 150 are to be adjusted, and perhaps how one or more additional ones of the pump units 150 will also be engaged, so that the pumping system 135 will achieve the new cumulative pumping rate.

The method 500 comprises generating 510 a list of the going-up pump units and a list of the going-down pump units. A transition schedule is then generated 520 based on whether a total rate change request is an increase or a decrease and by selecting transitions from the generated up/down pump lists in the order that is most conducive for avoiding spikes and dips. Special transition steps may also be generated 530 for shifting pump gears, such as by estimating the dip that would be caused due to the gear shift, and by stacking pumps that can compensate for such dip by throttling up temporarily and then throttling back down when the dip is over. The transitions in the transition schedule are then executed 540 one by one, separated by a configurable delay. The special transitions are also performed 550 with, for example, a time-based strategy to closely align the dip of the gear shifting pump(s) with the rise and fall in rate from the compensating pump(s).

The method 500 may be implemented via one or more algorithms and/or computer programs to be executed by a controller (such as the controller 161, 310) to simultaneously and automatically operate a plurality of gear-shifting pump units (such as the pump units 150). The algorithms and/or computer programs may be entered into the controller (e.g., as part of the coded instructions 332) and executed by the controller to cause pumping operations at intended flow rates substantially without manual control by the wellsite operator 164. The method 500 may be utilized/performed by the controller to operate the pump units to compensate for each other's flow rate and pressure dips and spikes during throttle and/or gear changing processes to achieve smooth transitions of the cumulative pumping rate of the pumping system 135. For example, a flow rate dip resulting from shifting up gears of a first one of the pump units 150 may be negated, cancelled, or otherwise compensated for by a second one of the pump units 150 simultaneously throttling up, such that the increased flow rate of the second pump unit 150 compensates for the flow rate dip of the first pump unit 150 during the gear shift, thus maintaining a substantially smooth combined flow rate of the first and second pump units 150.

Such compensation for flow rate dips due to gear shifts may be achieved by analyzing historical data to empirically estimate how flow rates change in response to throttle changes across different gears, throttle changes across different types of pumps, motors, transmissions, and their combinations (i.e., pump units), and/or throttle changes across different pressures. This knowledge can be used to operate multiple pump units simultaneously, while offsetting rate dips due to gear shifts.

Figure 7:
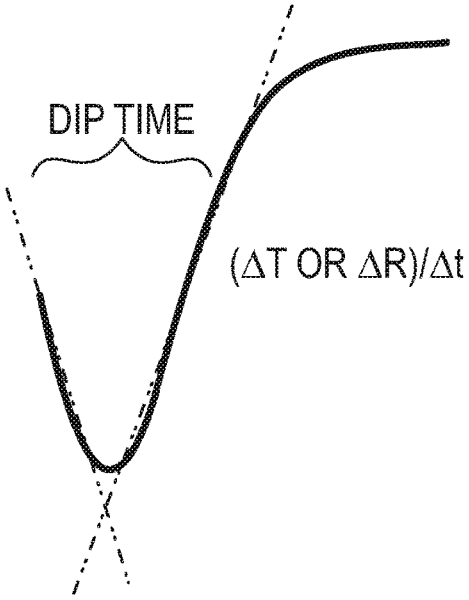
FIGS. 7-10 are graphic depictions related to one or more aspects of the present disclosure.
Figure 8:
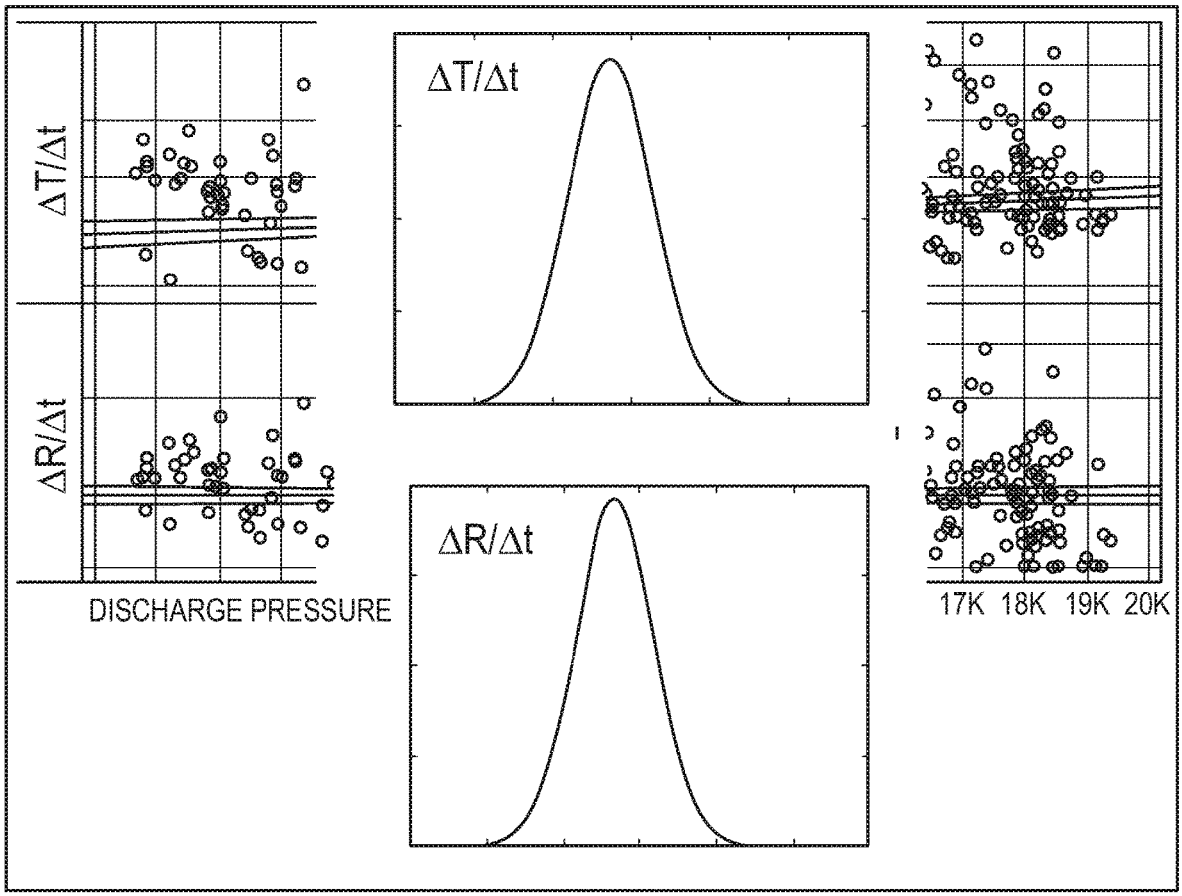
Figure 9:
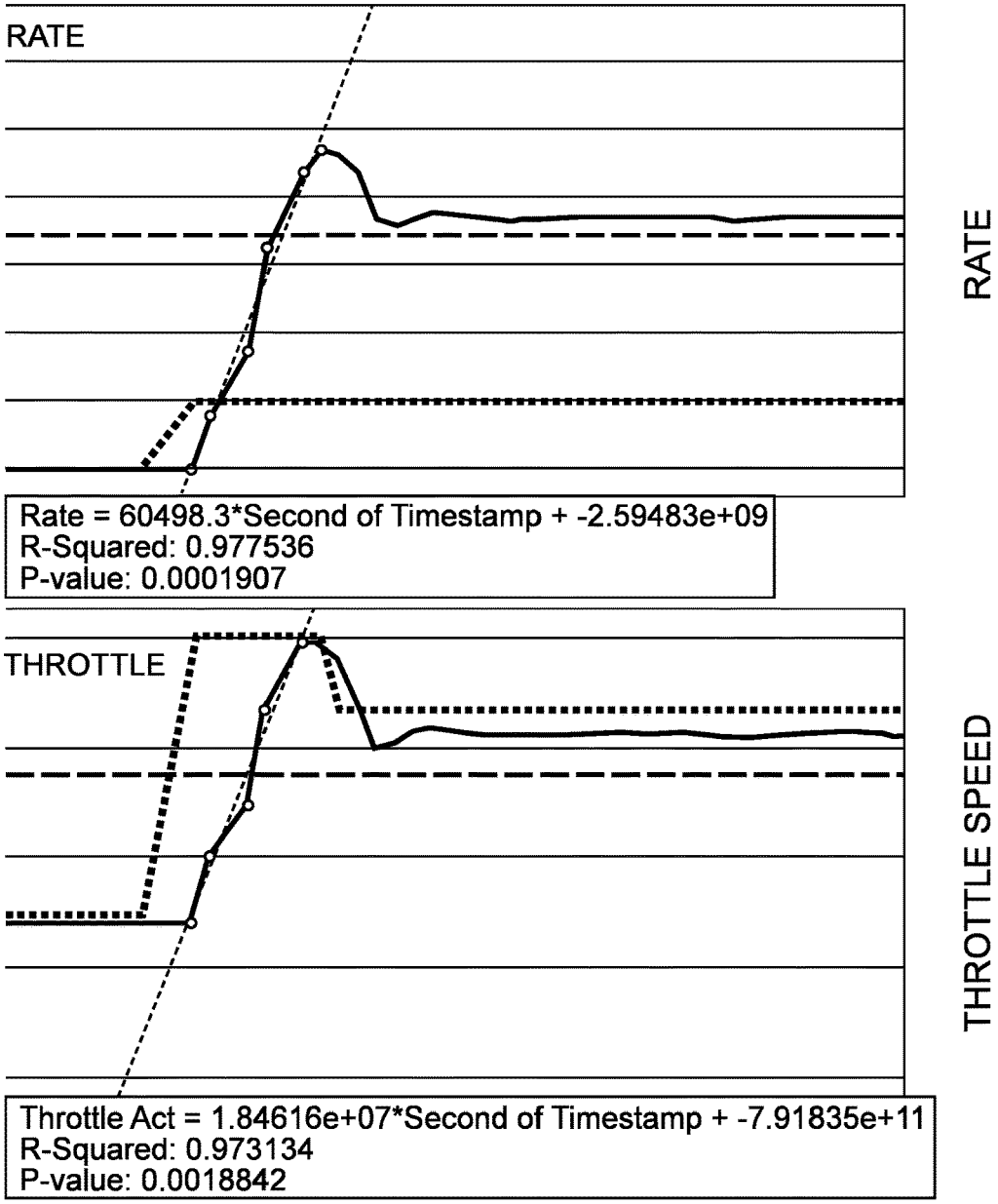
Figure 10:
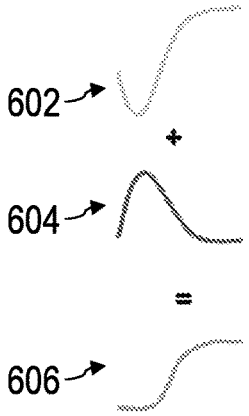

For example, an archive of historical pump unit operation data may be mined to extract information related to throttle and rate change behavior across a wide variety of pump units operating over a wide variety of jobs and operating conditions. Changes in flow rate and throttle may be analyzed during gear shift transitions. Change rates can be determined via the slope of the flow rate and throttle during the gear shifts. For example, $\Delta T/\Delta t$ and $\Delta R/\Delta t$ (where $\Delta$ is delta, T is throttle, t is time, and R is flow rate), may be determined for each gear shift within the data set, as schematically depicted in FIG. 7. The $\Delta T/\Delta t$ and $\Delta R/\Delta t$ values may be collected based on engine/transmission types, and these $\Delta T/\Delta t$ and $\Delta R/\Delta t$ values may be plotted against discharge pressure, as depicted in FIG. 8. Normal distributions of the results may then be used to generate approximate estimates for $\Delta T/\Delta t$ and $\Delta R/\Delta t$, as also depicted in FIG. 8 and in FIG. 9. As depicted in FIG. 10, the estimated $\Delta T/\Delta t$ and $\Delta R/\Delta t$ 602 can then be used to generate smoothing profiles 604 to be executed by other pump units, thereby achieving a smoother flow rate and/or pressure 606.

Figure 11:
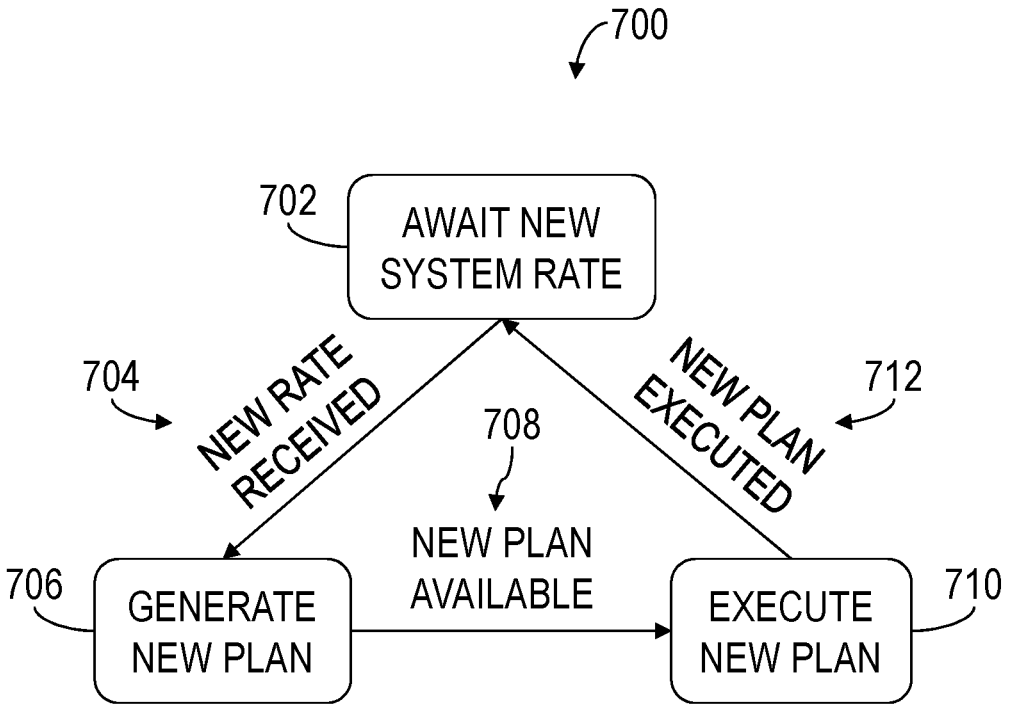
FIG. 11 is a schematic associated with the example method depicted in FIG. 6.

FIG. 11 is a schematic of at least a portion of an example implementation of a method 700 in which the method 500 and other aspects above may be utilized. During a waiting stage 702, the controller waits for the next target rate. When a new target rate is received 704 (from a wellsite operator 164, another user, a controller/processing device, etc.), the controller enters a planning stage and generates 706 a new plan assigning flow rate changes to the available pumps. When the new plan becomes available 708, the controller enters an execution stage during which the new plan is executed 710, such as may include execution of an implementation of the method 500. When the new plan has been executed 712, the controller again awaits 702 the next pumping system transition.

The new plan may be generated 706 utilizing a transition planner, such as set forth below in Table 1.

TABLE 1

Example Transition Planner

| Pump Unit | Current Rate | Give | Target Rate | Rate Increase | Gear Change? | Fast Lockup? |
|---|---|---|---|---|---|---|
| 1 | 4.3 | 0.2 | 4.5 | +0.2 | No | n/a |
| 2 | 4.3 | 0.2 | 6.8 | +2.5 | Yes | No |
| 3 | 5.3 | 0.8 | 7.3 | +2.0 | Yes | No |
| 4 | 4.1 | 0.4 | 4.5 | +0.4 | No | n/a |
| 5 | 4.2 | 0.3 | 4.2 | 0 | n/a | n/a |
| 6 | 6.2 | 0.3 | 6.2 | 0 | n/a | n/a |

In the table above, "give" is the amount of additional rate that a pump unit can provide without changing gears. Thus, in the example set forth in the table above, pump unit 1 is currently at 4.3 barrels per minute (bpm), and has a target rate of 4.5 bpm. This results in a rate increase of 0.2 bpm, which doesn't exceed the 0.2 give, so the rate increase can be accomplished by throttling up the pump motor without changing gears. However, pump unit 2 is currently at 4.3 bpm and has a target rate of 6.8 bpm. This results in a rate increase of 2.5 bpm, which exceeds the 0.2 give, so the rate increase will be accomplished by (at least) changing gears. Thus, the transition planner provides a snapshot of the planned transitions, can be used as a base for planning different combinations of transitions, and can also be used to determine each pump unit's give (e.g., based on an Automatic Rate Control (ARC) and/or other algorithm, process, or controller utilized in conjunction with each pump unit).

The transition schedule includes the transition steps and their execution order. Each step can include one or more pump units transitioning together to produce a smooth combined rate curve. As described above, the pump units are sorted into those going up in rate and those going down in rate. Transition steps are formed from the two groups, ordering pump units from largest to smallest rate change but alternating between the two groups, such as the "going up" pump unit having the largest change, then the "going down" pump unit having the largest change, then the "going up" pump unit having the second largest change, then the "going down" pump unit having the second largest change, and so on, with each step producing a smooth up or down transition.

As an example, each transition step may comprise a list of the one or more pump units involved in that transition step (e.g., Pump 1, Pump 2, Pump 5), the rate setpoints for those pump units (e.g., 5.2 bpm, 4.1 bpm, 4.4 bpm), a net effect of the new rates (e.g., +2.0 bpm), a flag or marker indicating that the transition step is a special transition step, and a combination index. A special transition step is one in which a pump unit that is changing gears is accompanied by a pump unit having give that will return back to its original rate after compensating for the dip. The combination index is an index representing a group of combinable transition steps. The transition steps are created in such an order as to reduce or prevent undershoot and overshoot, based on the net effect of the step and whether the total rate is aimed to increase or decrease, and the assigned rate so far. An example algorithm may be at least similar to the following:

```
if (totalRateChange > 0))
  while (all pump unit transitions have not been added to transition
  schedule)
    if (a "going down" pump unit can be added without the assigned
      rate so far going negative)
      AddToSchedule ("going down" pump unit with largest rate
      decrease)
    else
      AddToSchedule ("going up" pump unit with largest rate increase)
else
  while (all pump unit transitions have not been added to transition
  schedule)
    if (a "going up" pump unit can be added without the assigned
      rate so far going positive)
      AddToSchedule("going up" pump unit with largest rate increase)
    else
      AddToSchedule("going down" pump unit with larges
```

The AddToSchedule action estimates whether a gear change is required. For example, if a gear change is not required, then the pump unit is added to the transition schedule. However, if a gear change is required, then the dip due to gear shift is estimated (based on, for example, data collected from historical analysis, as described above), the give of each available pump unit is determined, compensating pump units are assigned with an amount of rate increase sufficient to buffer the dip caused by the gear shift, and the shifting pump unit and buffering pump units are added to the transition schedule.

The transition steps are then combined, when possible. For example, two transition steps may be combinable if (1) they have no overlapping pump units in their pump unit lists, and (2) if their net effects are of different signs, and (3) if combining them would not change the order of net effects signage of the transition steps, and (4) if none of the pump units in the second transition step are part of the lists of any of the steps in between.

Each combined transition step may then be executed. For example, a millisecond-based timer may be utilized to align compensating pump units and to schedule in such a way as to maintain the configured ramp up and ramp down slope. While executing a special transition step, the duration of the corresponding dip may be estimated based on historical data and used to closely control when the compensating pump units increase their rates, when the compensating pump units subsequently decrease their rates, and when the compensation is over, and perhaps also for managing the slopes of the dipping pump unit and the sum of the compensating pump units so that they align to form as near-ideal of a compensation as possible.

Table 2 set forth below provides an example of a rate distribution plan that may be generated 706 as described above.

TABLE 2

Example Rate Distribution Plan

| Pump Unit | Current Rate (bpm) | New Rate (bpm) |
|---|---|---|
| 1 | 0 | 3.8 |
| 2 | 3.8 | 5.2 |
| 3 | 4.1 | 4.5 |
| 4 | 3.8 | 4.1 |
| 5 | 3.8 | 4.5 |

In the example shown in Table 2, the cumulative pumping rate of the pumping system is being transitioned from 15.5 bpm to 22.1 bpm, including the addition of pump unit 1 and the ramp up of pump units 2-5. Table 3 set forth below provides an example of a corresponding transition schedule that may be generated and executed 710 utilizing the method 500.

TABLE 3

Example Transition Schedule

| Step | Pump Unit | New Rate (bpm) | Post Step Wait (second) | Post Step Cum. Rate (bpm) |
|---|---|---|---|---|
| 1 | 1 | 3.8 | $x_1$ | 19.3 |
| 2 | 2 | 5.2 | $x_2$ | 21.0 |
| | 4 | 4.1 | | |
| 3 | 3 | 4.5 | $x_3$ | 21.4 |
| | 4 | 4.3 | | |
| | 4 | 4.1 | | |
| 4 | 5 | 4.5 | $x_4$ | 22.1 |
| | 4 | 4.3 | | |
| | 4 | 4.1 | | |

Step 1 includes increasing pump unit 1 to 3.8 bpm, and then waiting for a period of $x_1$ seconds and/or until the cumulative pumping rate of the pumping system increases to (and perhaps substantially stabilizes at) 19.3 bpm. Step 2 includes increasing pump unit 2 to 5.2 bpm and increasing pump unit 4 to 4.1 bpm, and then waiting for a period of $x_2$ seconds and/or until the cumulative pumping rate of the pumping system increases to (and perhaps substantially stabilizes at) 21.0 bpm. Step 3 includes increasing pump unit 3 to 4.5 bpm and temporarily increasing pump unit 4 to 4.3 bpm to compensate for the dip caused by the increase of pump unit 3 (e.g., due to a gear shift), then decreasing pump unit 4 back to 4.1 bpm, and then waiting for a period of $x_3$ seconds and/or until the cumulative pumping rate of the pumping system increases to (and perhaps substantially stabilizes at) 21.4 bpm. Step 4 includes increasing pump unit 5 to 4.5 bpm and temporarily increasing pump unit 4 to 4.3 bpm to compensate for the dip caused by the increase of pump unit 5 (e.g., due to a gear shift), then decreasing pump unit 4 back to 4.1 bpm, and then waiting for a period of $x_4$ seconds and/or until the cumulative pumping rate of the pumping system increases to (and perhaps substantially stabilizes at) 22.1 bpm. The time periods $x_1$, $x_2$, $x_3$, and $x_4$ may be different or the same.

In view of the entirety of the present disclosure, including the figures and the claims, a person having ordinary skill in the art will readily recognize that the present disclosure introduces an apparatus that includes a controller comprising a processor and a memory storing coded instructions that, when executed by the processor, are for operation of the controller to change a cumulative pumping rate of a plurality of pump units of a pumping system by adjusting individual pumping rates of the pump units, including such that each temporary dip or spike of an individual pumping rate of one of the pump units is automatically offset by a predetermined temporary adjustment of an individual pumping rate of another one or more of the pump units to thereby reduce effects of the temporary dip or spike on the cumulative pumping rate of the pump units.

The controller may be a first controller, the apparatus may comprise a second controller comprising a processor and a memory storing coded instructions, and the first or second controller may be operable to: receive a rate distribution plan describing each adjustment to the individual pumping rate of each pump unit that will accomplish the cumulative pumping rate change; and generate a transition schedule of ordered transition steps to be executed to accomplish the cumulative pumping rate change, wherein each transition step includes the total adjustment of the individual pumping rate to be accomplished for at least one of the pump units, and wherein the transition steps are ordered by decreasing magnitude of alternating increasing and decreasing individual pumping rate adjustments. The at least one of the pump units for which the total individual pumping rate adjustment is to be accomplished in each transition step may be a first pump unit, and at least one of the transition steps may further include a temporary adjustment to the individual pumping rate of a second one of the pump units to compensate for a temporary dip or spike in the cumulative pumping rate that would otherwise be caused by the total adjustment of the individual pumping rate being accomplished for the first pump unit in that transition step. The ordered transition steps may include a first transition step and subsequent transition steps, wherein: if the cumulative pumping rate change is an increase from a first cumulative pumping rate to a second cumulative pumping rate, and the magnitude of the largest decreasing individual pumping rate adjustment is less than the first cumulative pumping rate, then the first transition step may include the total adjustment to be accomplished for the pump unit corresponding to the largest decreasing individual pumping rate adjustment; and if the cumulative pumping rate change is an increase from a first cumulative pumping rate to a second cumulative pumping rate, and the magnitude of the largest decreasing individual pumping rate adjustment is greater than the first cumulative pumping rate, then the first transition step may include the total adjustment to be accomplished for the pump unit corresponding to the largest increasing individual pumping rate adjustment.

The present disclosure also introduces a method comprising causing operation of a controller to change a cumulative pumping rate of a plurality of pump units by adjusting individual pumping rates of the pump units, wherein each temporary dip or spike of an individual pumping rate of one of the pump units is automatically offset by a predetermined temporary adjustment of an individual pumping rate of another one or more of the pump units to thereby reduce effects of the temporary dip or spike on the cumulative pumping rate of the pump units.

The controller may be a first controller, and the method may further comprise causing operation of the first controller or a second controller to: receive a rate distribution plan describing each adjustment to the individual pumping rate of each pump unit that will accomplish the cumulative pumping rate change; and generate a transition schedule of ordered transition steps to be executed to accomplish the cumulative pumping rate change, wherein each transition step includes the total adjustment to the individual pumping rate to be accomplished for at least one of the pump units, and wherein the transition steps are ordered by decreasing magnitude of alternating increasing and decreasing individual pumping rate adjustments. The at least one of the pump units for which the total individual pumping rate adjustment is to be accomplished in each transition step may be a first pump unit, and at least one of the transition steps may further include a temporary adjustment to the individual pumping rate of a second one of the pump units to compensate for a temporary dip or spike in the cumulative pumping rate that would otherwise be caused by the total adjustment of the individual pumping rate being accomplished for the first pump unit in that transition step. The ordered transition steps may include a first transition step and subsequent transition steps, wherein: if the cumulative pumping rate change is an increase from a first cumulative pumping rate to a second cumulative pumping rate, and the magnitude of the largest decreasing individual pumping rate adjustment is less than the first cumulative pumping rate, then the first transition step may include the total adjustment to be accomplished for the pump unit corresponding to the largest decreasing individual pumping rate adjustment; and if the cumulative pumping rate change is an increase from a first cumulative pumping rate to a second cumulative pumping rate, and the magnitude of the largest decreasing individual pumping rate adjustment is greater than the first cumulative pumping rate, then the first transition step may include the total adjustment to be accomplished for the pump unit corresponding to the largest increasing individual pumping rate adjustment.

The present disclosure also introduces a method comprising: (A) receiving a rate distribution plan describing each adjustment to individual pumping rates of a plurality of pump units that will accomplish a cumulative pumping rate change of a pumping system comprising the pump units; (B) grouping the pump units into: (i) a first group comprising the ones of the pump units for which the individual pumping rates adjustments are increases; and (ii) a second group comprising the other ones of the pump units for which the individual pumping rates adjustments are decreases; (C) generating a first list of the pump units in the first group sorted by magnitude of the increases; (D) generating a second list of the pump units in the second group sorted by magnitude of the decreases; and (E) generating a transition schedule of ordered transition steps to be executed to accomplish the cumulative pumping rate change, wherein each transition step includes the individual pumping rate adjustment to be accomplished for one of the pump units, and wherein the transition steps are ordered by decreasing magnitude of alternating increasing and decreasing individual pumping rate adjustments.

The method may further comprise: (A) determining that first ones of the transition steps will cause a temporary dip in the cumulative pumping rate of the pumping system; (B) adding to each of the first transition steps: (i) an increase to the individual pumping rate of another, dip-compensating one of the pump units to coincide with the temporary dip in the cumulative pumping rate of the pumping system; and (ii) a subsequent decrease of the individual pumping rate of the dip-compensating pump unit to restore the dip-compensating pump unit to its individual pumping rate at the beginning of that first transition step; (C) determining that second ones of the transition steps will cause a temporary spike in the cumulative pumping rate of the pumping system; and (D) adding to each of the second transition steps: (i) a decrease in the individual pumping rate of another, spike-compensating one of the pump units to coincide with the temporary spike in the cumulative pumping rate of the pumping system; and (ii) a subsequent increase of the individual pumping rate of the spike-compensating pump unit to restore the spike-compensating pump unit to its individual pumping rate at the beginning of that second transition step.

The ordered transition steps may include a first transition step and subsequent transition steps, and: if the cumulative pumping rate change is an increase from a first cumulative pumping rate to a second cumulative pumping rate, and the magnitude of the largest decreasing individual pumping rate adjustment is less than the first cumulative pumping rate, then the first transition step may include the total adjustment to be accomplished for the pump unit corresponding to the largest decreasing individual pumping rate adjustment; and if the cumulative pumping rate change is an increase from a first cumulative pumping rate to a second cumulative pumping rate, and the magnitude of the largest decreasing individual pumping rate adjustment is greater than the first cumulative pumping rate, then the first transition step may include the total adjustment to be accomplished for the pump unit corresponding to the largest increasing individual pumping rate adjustment.

The method may further comprise combining a first one of the transition steps and a second, later-ordered one of the transition steps into a single transition step if: the first and second transition steps do not include any of the same ones of the pump units; the first and second transition steps have opposite net effects on the cumulative pumping rate; combining the first and second transition steps does not change the order of net effects signage of all of the transition steps; and none of the pump units in the second transition step form part of any of the other transition steps occurring between the first and second transition steps.

The present disclosure also introduces an apparatus comprising a coordinating controller capable of communicatively connecting to each pump unit controller of a plurality of pump units, wherein: each pump unit controller is in communication with at least one of a variable frequency drive, an engine throttle, a gear shifter, a prime mover, or a transmission of the corresponding pump unit; the coordinating controller comprises a programmable processor having a memory device and an interface circuit connected to an input device; the programmable processor is operable to process coded instructions from the input device and communicate the coded instructions to the pump unit controllers; the at least one of the variable frequency drive, the engine throttle, the gear shifter, the prime mover, and/or the transmission of each pump unit is responsive to the coded instructions to change a cumulative pumping rate of the pump units; and each temporary dip or spike of an individual pumping rate of one of the pump units is automatically offset by a predetermined temporary adjustment of an individual pumping rate of another one or more of the pump units to thereby reduce effects of the temporary dip or spike on the cumulative pumping rate of the pump units.

The coordinating controller or another controller of the apparatus may be operable to: receive a rate distribution plan describing each adjustment to the individual pumping rate of each pump unit that will accomplish the cumulative pumping rate change; and generate a transition schedule of ordered transition steps to be executed to accomplish the cumulative pumping rate change, wherein each transition step includes the total adjustment of the individual pumping rate to be accomplished for at least one of the pump units, and wherein the transition steps are ordered by decreasing magnitude of alternating increasing and decreasing individual pumping rate adjustments. The at least one of the pump units for which the total individual pumping rate adjustment is to be accomplished in each transition step may be a first pump unit, and at least one of the transition steps may further include a temporary adjustment to the individual pumping rate of a second one of the pump units to compensate for a temporary dip or spike in the cumulative pumping rate that would otherwise be caused by the total adjustment of the individual pumping rate being accomplished for the first pump unit in that transition step. The ordered transition steps may include a first transition step and subsequent transition steps, and: if the cumulative pumping rate change is an increase from a first cumulative pumping rate to a second cumulative pumping rate, and the magnitude of the largest decreasing individual pumping rate adjustment is less than the first cumulative pumping rate, then the first transition step may include the total adjustment to be accomplished for the pump unit corresponding to the largest decreasing individual pumping rate adjustment; and if the cumulative pumping rate change is an increase from a first cumulative pumping rate to a second cumulative pumping rate, and the magnitude of the largest decreasing individual pumping rate adjustment is greater than the first cumulative pumping rate, then the first transition step may include the total adjustment to be accomplished for the pump unit corresponding to the largest increasing individual pumping rate adjustment.

The foregoing outlines features of several embodiments so that a person having ordinary skill in the art may better understand the aspects of the present disclosure. A person having ordinary skill in the art should appreciate that they may readily use the present disclosure as a basis for designing or modifying other processes and structures for carrying out the same purposes and/or achieving the same advantages of the embodiments introduced herein. A person having ordinary skill in the art should also realize that such equivalent constructions do not depart from the scope of the present disclosure, and that they may make various changes, substitutions and alterations herein without departing from the spirit and scope of the present disclosure.

The Abstract at the end of this disclosure is provided to permit the reader to quickly ascertain the nature of the technical disclosure. It is submitted with the understanding that it will not be used to interpret or limit the scope or meaning of the claims.

What is claimed is:

1. An apparatus, comprising:

a controller that includes a processor and a memory storing instructions that, when executed by the processor, cause the processor to perform operations comprising:

receiving historical pump unit operation data associated with a plurality of pump units of a pump system;

generating one or more smoothing profiles based on the historical pump unit operation data, wherein the one or more smoothing profiles comprise respective values indicative of a change in throttle over a change in time;

detecting a transition in a pumping rate of a first pump unit of the plurality of pump units from a current rate to a target rate causing a temporary occurrence of one or more dips or one or more spikes in the pumping rate of the first pump unit, wherein the transition includes at least one of a gear shift or a throttle change of the first pump unit of the plurality of pump units; and transmitting the one or more smoothing profiles to one or more second pump units of the plurality of pump units in response to detecting the transition in the pumping rate of the first pump unit, wherein the one or more second pump units are configured to execute the one or more smoothing profiles to offset the one or more dips in the first pump unit by increasing a rate or a pressure of the one or more second pump units, or to offset the one or more spikes in the first pump unit by decreasing the rate or the pressure of the one or more second pump units, or both, to reduce overall variations in a cumulative pumping rate or a cumulative pressure of the plurality of pump units during the transition in the pumping rate of the first pump unit.

2. The apparatus of claim 1, wherein the one or more smoothing profiles comprise respective values indicative of a change in flow rate over a change in time.

3. The apparatus of claim 2, wherein the historical pump unit operation data comprises throttle data associated with at least one pump unit of the plurality of pump units and flow rate data associated with the at least one pump unit of the plurality of pump units.

4. The apparatus of claim 1, wherein the operations comprise monitoring an automation state, or one or more operation parameters, or both, of the plurality of pump units.

5. The apparatus of claim 1, wherein the one or more second pump units comprise two or more second pump units, and the two or more second pump units are configured to execute the one or more smoothing profiles simultaneously to offset the one or more dips in the first pump unit, or to offset the one or more spikes in the first pump unit, or both, to reduce the overall variations in the cumulative pumping rate or the cumulative pressure of the plurality of pump units during the transition in the pumping rate of the first pump unit.

6. The apparatus of claim 1, wherein the transition includes the gear shift of the first pump unit of the plurality of pump units.

7. The system of claim 1, wherein the one or more smoothing profiles comprise an upward sloped portion to minimize a dip, a downward sloped portion to minimize a spike, or any combination thereof.

8. The system of claim 7, wherein the transition includes the gear shift of the first pump unit of the plurality of pump units.

9. The system of claim 1, wherein the one or more smoothing profiles comprise a curved profile.

10. The system of claim 9, wherein the curved profile comprises an upward curved portion and a downward curved portion.

11. The system of claim 1, wherein the one or more second pump units are configured to automatically offset the one or more dips in the first pump unit, the one or more spikes in the first pump unit, or both, with a predetermined temporary adjustment to the one or more second pump units corresponding to the one or more smoothing profiles.

12. A method, comprising:

receiving, via a controller, historical pump unit operation data associated with a plurality of pump units of a pump system;

generating, via the controller, one or more smoothing profiles based on the historical pump unit operation data, wherein the one or more smoothing profiles comprise respective values indicative of a change in throttle over a change in time;

detecting a transition in a pumping rate of a first pump unit of the plurality of pump units from a current rate to a target rate causing a temporary occurrence of one or more dips or one or more spikes in the pumping rate of the first pump unit, wherein the transition includes at least one of a gear shift or a throttle change of the first pump unit of the plurality of pump units; and transmitting, via the controller, the one or more smoothing profiles to one or more second pump units of the plurality of pump units in response to detecting the transition in the pumping rate of the first pump unit, wherein the one or more second pump units are configured to execute the one or more smoothing profiles to offset the one or more dips in the first pump unit by increasing a rate or a pressure of the one or more second pump units, or to offset the one or more spikes in the first pump unit by decreasing the rate or the pressure of the one or more second pump units, or both, to reduce overall variations in a cumulative pumping rate or a cumulative pressure of the plurality of pump units during the transition in the pumping rate of the first pump unit.

13. The method of claim 12, wherein the one or more smoothing profiles comprise respective values indicative of a change in flow rate over a change in time, wherein the historical pump unit operation data comprises throttle data associated with at least one pump unit of the plurality of pump units and flow rate data associated with the at least one pump unit of the plurality of pump units.

14. The method of claim 12, wherein the one or more smoothing profiles comprise a curved profile having an upward sloped portion to minimize a dip, a downward sloped portion to minimize a spike, or any combination thereof, wherein the one or more second pump units are configured to automatically offset the one or more dips in the first pump unit, the one or more spikes in the first pump unit, or both, with a predetermined temporary adjustment to the one or more second pump units corresponding to the one or more smoothing profiles.

15. The method of claim 12, wherein the one or more second pump units comprise two or more second pump units configured to execute the one or more smoothing profiles to offset the one or more dips in the first pump unit, or the one or more spikes in the first pump unit, or both, to reduce the overall variations in the cumulative pumping rate or the cumulative pressure of the plurality of pump units during the transition in the pumping rate of the first pump unit.

16. A system, comprising:

a plurality of pump units;

a controller that includes a processor and a memory storing instructions that, when executed by the processor, cause the processor to perform operations comprising:

receiving one or more smoothing profiles, wherein the one or more smoothing profiles comprise respective values indicative of a change in throttle over a change in time or a change in flow rate over a change in time;

detecting a transition in a pumping rate of a first pump unit of the plurality of pump units from a current rate to a target rate causing a temporary occurrence of one or more dips or one or more spikes in the pumping rate of the first pump unit, wherein the transition includes at least one of a gear shift or a throttle change of the first pump unit of the plurality of pump units; and transmitting the one or more smoothing profiles to one or more second pump units of the plurality of pump units in response to detecting the transition in the pumping rate of the first pump unit, wherein the one or more second pump units are configured to execute the one or more smoothing profiles to offset the one or more dips in the first pump unit by increasing a rate or a pressure of the one or more second pump units, or to offset the one or more spikes in the first pump unit by decreasing the rate or the pressure of the one or more second pump units, or both, to reduce overall variations in a cumulative pumping rate or a cumulative pressure of the plurality of pump units during the transition in the pumping rate of the first pump unit.

17. The system of claim 16, comprising:

receiving historical pump unit operation data associated with the plurality of pump units; and generating the one or more smoothing profiles based on the historical pump unit operation data.

18. The system of claim 17, wherein the historical pump unit operation data comprises throttle data associated with at least one pump unit of the plurality of pump units, or flow rate data associated with the at least one pump unit of the plurality of pump units, or any combination thereof.

19. The system of claim 16, wherein the one or more smoothing profiles comprise a curved profile having an upward sloped portion to minimize a dip, a downward sloped portion to minimize a spike, or any combination thereof, wherein the one or more second pump units are configured to automatically offset the one or more dips in the first pump unit, the one or more spikes in the first pump unit, or both, with a predetermined temporary adjustment to the one or more second pump units corresponding to the curved profile of the one or more smoothing profiles.

20. The system of claim 16, wherein the one or more second pump units comprise two or more second pump units, and the two or more second pump units are configured to execute the one or more smoothing profiles simultaneously to offset the one or more dips in the first pump unit, or to offset the one or more spikes in the first pump unit, or both, to reduce the overall variations in the cumulative pumping rate or the cumulative pressure of the plurality of pump units during the transition in the pumping rate of the first pump unit.

* * * * *